United States Patent [19]

Engelhardt

[11] Patent Number: 4,681,253

[45] Date of Patent: Jul. 21, 1987

[54] EFFICIENCY PHOTO-GRAM WITH STAND-UP DISPLAY

[76] Inventor: Jonathan A. Engelhardt, Box 90361, San Diego, Calif. 92109

[21] Appl. No.: 753,917

[22] Filed: Jul. 11, 1985

[51] Int. Cl.[4] ..... B65D 27/04

[52] U.S. Cl. ..... 229/92.8; 40/152.1

[58] Field of Search ..... 229/92.8; 40/152.1, 40/158 R

[56] References Cited

U.S. PATENT DOCUMENTS

| | | | |
|---|---|---|---|
| 922,035 | 5/1909 | Pifer | 229/92.8 |
| 1,347,269 | 7/1920 | Greble | 40/152.1 |
| 2,219,492 | 10/1940 | Prichap | 40/152.1 |
| 2,878,607 | 3/1959 | Alves | 40/158 R |
| 3,174,244 | 3/1965 | Walton | 40/158 R |
| 3,304,641 | 2/1967 | Gonczy | 229/92.8 |
| 4,008,852 | 2/1977 | Davis | 229/92.8 |
| 4,167,241 | 9/1979 | Zumbrunn | 229/92.8 |
| 4,244,511 | 1/1981 | Coleman | 229/92.3 |
| 4,332,095 | 6/1982 | Tanney | 40/152.1 |

FOREIGN PATENT DOCUMENTS

| | | | |
|---|---|---|---|
| 80702 | 4/1919 | Switzerland | 229/92.8 |
| 7988 | 6/1905 | United Kingdom | 229/92.8 |

*Primary Examiner*—Stephen P. Garbe

[57] ABSTRACT

An efficiency Photo-mailer item, uniquely conifigured in a special unitary panel Di-scored/Tri-sectioned format, so that Senders preferred photograph is presented through a protective glazed-aperture at the central front panel adjacent to the address indicia-space, yet the novel arrangement enables said photo to again reappear in proper orientation to view as one unfolds the panel to read the accompanying personal-letter portion, contained in relative privacy within the confines of the inside back-panel section during mailing; plus, the provision of a uniquely attractive display-modality, through result of a natural 'splay-leg' effect achieved via said scored deformation of the card-stock material, in conjunction with an auxiliary retension provision for use on slick surfaces; the said aggregate folded panel sections being maintained closed during mailing via provisionary 'stays'.

7 Claims, 6 Drawing Figures

EFFICIENCY PHOTO-GRAM WITH STAND-UP DISPLAY

FIELD OF INVENTION

The present invention relates to specialized postcard like envelopes constructed as Photo-mailers, specifically configured to contain written material in conjunction with a custom-picture viewing aperture, so arranged as to provide a particularly functional display modality of use by the Recipient.

Heretofore, such attempts by other inventors to create an economically merchandizable as well as functionally and esthetically attractive Photo-mailer item have presented several notable deficiencies, much to the exasperation of both Sender & Receiver alike. Such products may exhibit the Senders photo nicely on the closed outside, or opened inside, but become very inefficient as to space-utilization when a complex layout is employed in order to attain both sequences of Photo-mailer usage. Accordingly, another problem encountered with previous Photo-mailer design configurations is, that some rely upon sufficient dexterity of the user to carefully tear-out pre-preforated portions for the viewing-aperture, or for a supplemental swing-out supporting-leg to facilitate display use; or do not provide adaquate mailing protection for a valued photo.

GENERAL DESCRIPTION OF INVENTION

However, all these afore named deficiencies are effectively overcome by the present 'Photogram' invention, which sets forth a simple one-piece di-scored/tri-sectional panel format, wherein Sanders photo is applied to a pre-registered universal-photo space adjacent to the lined space indicated for salutation and commencement of Sender's personal communique.

It is therefore, the object of this invention, to provide a simple unitary panel format remiss of extraneous flaps and perforations, preferably comprised of a standard $8\frac{1}{2}'' \times 11''$-sheet of conventional card-stock material presenting a preferred American height-to-width ratio of about 1.3:1; said material being 10/lb.-gauge, finished with a gloss-coating on the outer facing panel surface area.

It is a further object of this invention, to provide dual scoring-folds across the width of the card, thereby dividing the sheet into three panel-sections on each opposing side, six-sections in total; whereby the center-section is made greatest in height relative to the outside/upper-section, as the said upper-section is about $\frac{1}{4}''$ to $\frac{3}{8}''$—shorter in length of height so as to facilitate provision of an extra 7–15/degree-pitch aft-tilt of the photo-aperture in the semi-folded 'stance' during the Display-modality while upon a substantially flat level surface such as a desk-top, thereby making photo-aperture more conveniently observable.

It is another object of this invention, to obviate the usual confusion of supplemental-flaps favored for use in supporting Photo-mailers in a display-modality, and to accomodate virtually any proportion of photo-print to a practical limit of $3\frac{3}{4}'' \times 5''$ in the preferred $8\frac{1}{2}'' \times 11''$-sheet size.

It is another object of this invention, to provide a preferably clear cellophane-glazed aperture, arranged within the central-section of the inside-panel surface, so that a suitable photo applied to the inside/upper-section directly above will automatically register in the window-aperture during the folded-modality of usage, yet subsequently appear in correct orientation once the panel aggregate is unfolded for reading of attendant communique inside.

It is another object of this invention, to provide a very protective enclosure for a valued photo which may likely be an original, yet be readily accessible therefrom for easy transfer to a regular family photo-album.

It is another object of this invention, to provide ample printing area for optional artistic graphics and/or printed direct-mail advertising space, or conventional scenic-pictorial, on the upper/outside-section, in addition to the said custom photo provisions hereof.

It is another object of this invention, to provide a photo-mailer of maxium surface efficiency for Sender communication, in conjunction with the photo-display accomodations; yet remain sufficiently light of weight to require only the minimum 1st-Class Postage within the USA.

It is another object of this invention, to maintain 'closure' during postal-transit handling by virtue of at least one, preferably two, spot-adhesive Pads, of the type having user removable striping; said adhesive-pad(s) to be located at the distal extremity of the inside/lower-section surface.

It is another object of this invention, to provide an auxiliary spot/adhesive-pad on the inside/upper-section distal from the upper score-line, or, an optional 'half-moon' die-cut/tab entity thereto; for the purpose of retaining the upper inside panel section flatly against the inside/center-section, thereby negating any tendancy for the naturally splayed-legs to spread apart excessively due to card-stock 'springy creep' effect toward reopening, primarily occuring during display-modality upon a slick surface such as a plate-glass table-top.

It is another object of this invention, to present the Recipients address indicia-space directly adjacent to the externally viewable photo and aperture, thereby presenting the maximum possible 'presentation-impact' upon receipt from the Sender.

It is another object of this invention, to facilitate the maximum degree of 'user friendly' utility, whereby there is no confusion as to how to utilize the convenience built into this invention; hence, there is no awkward disorientation of the affixed photo as the Recipient unfolds the card sections, in a natural operational progression sequence to the fully opened reading-modality, and likewise, coversely easy to use when restoring the panel-sections to the fully closed mailing-modality which may also be convenient for storage during disuse.

While this invention will be described in conjunction with certain preferred embodiments, it is intended that this not limit the invention to such specific features; on the contrary, it is intended to cover all alternatives, modifications, and such equivalents which may be found within the spirit & scope of the invention, as is defined in the following Specifications. This invention was first revealed in my U.S. Pat. Office Disclosure Document No. 123,197 of Dec. 13, 1983, and is even further predated by my earlier private records.

BRIEF DESCRIPTION OF ILLUSTRATIONS

The proceeding summary, as well as further objects, features, and advantages of the present invention, will be more fully appreciated by reference to the following detailed descriptions of the special illustrative embodiments, which are in accordance with the present invention; wherein.

DETAILED DESCRIPTION OF THE INVENTION

The invention shall now be specified in reasonable detail, according to the preferred embodiments, and with direct reference to the exemplary illustrated features, having reference numbering for convenient identification purposes only.

Figure 1:
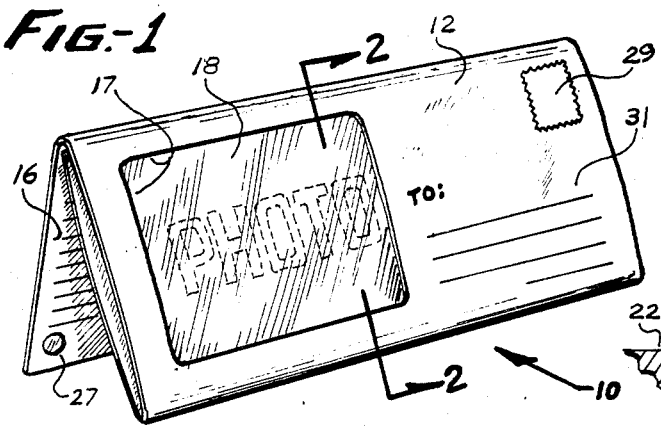
FIG. 1, is a ¾-frontal perspective view of the invention, showing its overall appearance in Display-modality.
Figure 2:
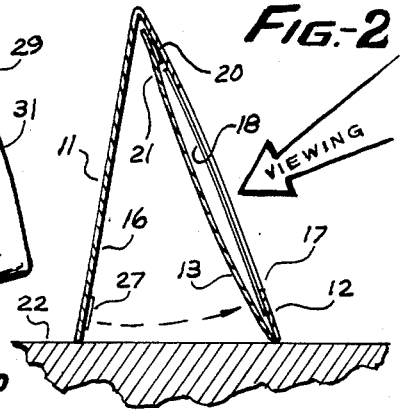
FIG. 2, is a right facing cross-sectional view of the preceeding FIG. 1 representation, wherein is revealed the novel stance provision of said Display-modality.

Accordingly, the pictorial view of FIG. 1 reveals a 'PhotoGram'-product assembly 10 as is essentially set-forth herein, while demonstrating the typical Display-modality, which reveals how the 'preview' photo-aperture 17 is a desirably dominant portion of the frontal outside/center-section 12, preferably including a protective transparent film-glazing 18 attached thereto. However, FIG. 2 really more precisely reveals the especially novel 'aft stance' tilted attitude provision, which is achieved by means of a ¼"–⅜"/abbreviated supporting-leg comprising panel section surfaces 16 and 11, thereby facilitating a desirable 7–15/degree additional aft-tilt of said frontal surface 12 for substantially more convenient viewing as is suggested by the accompanying arrow of FIG. 2.

Figure 3:
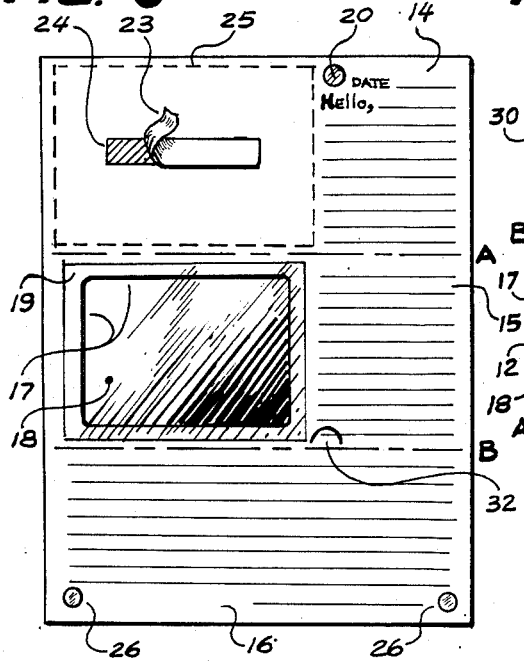
FIG. 3, is a directly projected full-layout view of the 'inside'-panel surface, otherwise refered to as the 'obverse'.
Figure 4:
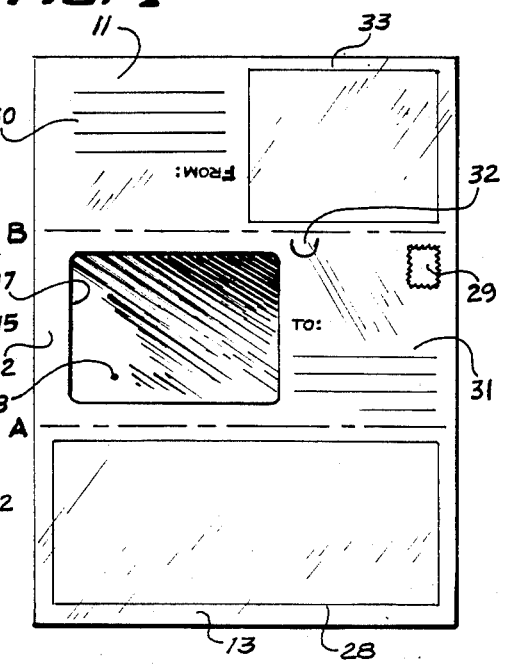
FIG. 4, is a directly projected full-layout view of the 'outside'-panel surface, shown in a normally vertically-inverted manner of orientation relative to prior FIG. 3.

Reference to FIGS. 3 and 4, shows how the PhotoGram product is remarkably economically produced from an essentially standard 8½"×11" card-stock material, which is di-scored, and hence tri-sectioned, so as to resultantly comprise six panel surface sections herein referred to as the Obverse-side and Inside generally. Note in FIG. 3 that a definite bias-fold is imposed by the production-scoring process, effecting the aggregate formation with a very natural overflap of the upper 14 and lower 16 panel sections, relative to the inside/center-section 15 which contains the said photo-aperture 17, along with said preferred glazing 18 adhesively affixed to the inside surface perimeter 19 around the said aperture. Another optional feature, is the auxiliary adhesive retension-pad 20, which nicely serves to negate any natural tendancy of the folded outside/lower-section 13 distal-edge surface entity 21 from exerting a 'springy'-pressure upon the the inside/lower-section inner-surface region 16, best exhibited by reference to FIG. 2. This special provision serves to negate any tendancy of the said panel sections to creep appart by spreading of the two legs, particularly useful when in Display-modality upon a very slick surface 22, which can be a glass Desk-top for example; thereby obviating user aggrevation experienced with some photo-mailer products which have no such provision for stabilizing the device under such conditions. Use of this retension-pad 20 would be simply via Recipients removal of a protective striping, and light pressuring of the said surfaces together.

Figure 5:
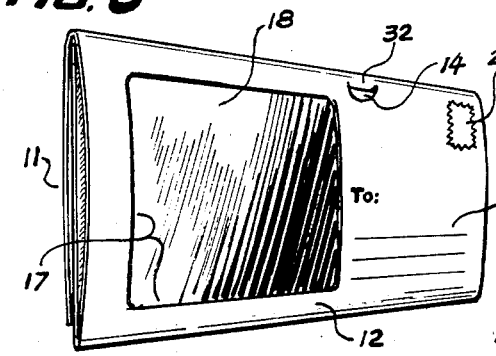
FIG. 5, is a ¾-frontal perspective view of the invention, demonstrating the preferred Mailing-modality.
Figure 6:
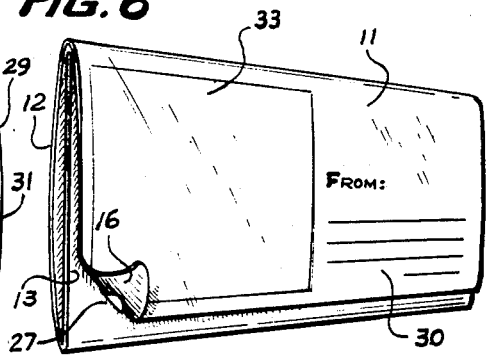
FIG. 6, is a ¾-rear perspective-view of the invention, demonstrating Recipient detatchment of a distal corner.

Notice also in FIGS. 3 and 4 how the opposing Obverse & Inside panel sides are particularly vertically inverted to each other, so as to facilitate a novel juxtapositioning of the respective folding sections, thereby arranged for maximum convenience and efficiency. Although a tongue-moistened adhesive means may be employed, FIG. 3 shows how a peel-away protective striping 23 is used to cover a preferred contact-adhesive 24 until removed by the Sender for prompt affixation of Senders own preferred photo or scenic picture-card 25. This is virtually all that the Sender needs to do, other than fill out the preferrably pre-lined indicia spaces provided for personal communication just adjacent thereto on inside sections 14/15/16 respectively. The Sender then merely folds section 14 180-degrees down upon section 15, which automatically registrates said photo 25 into precise alignment against the preferably pre-diecut aperture 17 of section 15; and next, has only to strip away the protective covering 26 from 'stay' contact-adhesive pads 27, and fold that section 16 180-degrees upward upon the said already folded section 13 surface, whereby the aggregate foldably closed sections are held fast by the said stays 27, until detachably re-opened by the Recipient as suggested in FIG. 6. Accordingly, it is therefore obvious now that the example of FIG. 5 represents the Mailing-modality, while the example of FIG. 3 represents the typical Reading-modality.

The concept of this PhotoGram-product invention is conceived both for use by the holiday-traveler, as well as for Direct-mail 'sales'-promotion; whereby the space 28 of outside/lower-section 13 is really ideally suited for a pre-printed decorative design, travel-collage scene, or, for imprinting of pictorial sales. This inventor belives that Realty and Car Dealers will welcome use of this novel format, as a relatively inexpensive, yet quite personalized sales-device. For example, when a customer has completed a test-drive in a Car of their selection, the salesman need only ask them to take a moment to pose by the vehicle, while the salesman snaps an instant Poloroid-type photo. The ready convenience of this invention in combination with 'instant photography' enables the salesman to quickly hand the customer an attractive PhotoGram containing the persons own likeness poised there with the Car of their desire—or, the PhotoGram may be mailed later to the customer, as a follow-up surprise gift from the dealership! Either way, an exciting new and dramatic psychological sales tool is offered, which forms a 'personalized' attachment of the Recipient for the product, which is more likely to lead to a purchase, when the Recipient proudly shows the Sales-PhotoGram to their friends who are positively impressed.

Other features of the invention, include the area for standard-postage 29, and mailing indicia-spaces 30 and 31 provided for both Senders & Recipients respective names. Another optional feature, provided for retension of panel-sections 13/14 is the provisional die-cut/half-moon shaped integral-tab 32, into which is inserted the foldably indexed distal edge of section 13/14, thereby affording substantially equivalent protection against occurance of 'springy creep' as described previously herein. Also, useful for artistic-graphics, is the area 33 of panel section 11, just adjacent to the essential back-flap Sender-indicia 30. It has been found in usage, that little or no instructional copy-space is needed, owing to the exceptional, if logical, utility designed into this Photo-Gram invention. The obverse panel side having sections 11/12/13, is preferably gloss-coated by the maker, enabling the said spot adhesive-pads 26 and 20 to be readily detached by the Recipient, without resulting mutulation damage to the attendant surface by the effect of detachably tearing away the adhesive-pad stay, as in FIG. 6.

Lastly, it will be apparent to those skilled in the art herein treated, that still further changes, alterations, and modifications, may be resorted to according to the format set-forth in the present embodiment, without departing from the intended spirit and scope of the invention which is further recited in the appended claims and their legal or technical equivalents.

What I claim of originality is:

1. A photo-mailer assembly comprising a unitary sheet of card stock having two generally parallel score lines which divide the sheet into upper, central, and lower panels of substantially equal size, said assembly further comprising inner and outer surfaces, a lateral direction parallel to the score lines and a longitudinal direction perpendicular to the score lines, said central panel including a laterally offset aperture for displaying a photograph, the inner surface of said upper panel including a laterally offset strip of adhesive for securing a photograph thereto in alignment with said aperture, the inner surface of said upper panel including adhesive for securing the inner surfaces of said upper and central panels together in a face-to-face relationship, the inner surface of said lower panel including adhesive for securing the inner surface of said lower panel and the outer surface of said upper panel in face-to-face relationship, the outer surface of said central panel including indicia for indicating the location of a recipient address and stamp for sending the assembly through the mail, both surfaces of said assembly being gloss-coated to facilitate detachment of the panels when they are secured in a face-to-face relationship.

2. The photo-mailer assembly according to claim 1 wherein said aperture is covered by a transparent film secured to the inner surface of the central panel.

3. The photo-mailer assembly according to claim 2 and further including a photograph secured to the inner surface of the upper panel.

4. The photo-mailer assembly according to claim 3 wherein the upper and central panels are secured in face-to-face relationship and the photograph is visible through the aperture.

5. The photo-mailer assembly according to claim 4 wherein the lower panel is folded about one of the score lines toward the outer face of the upper panel and forms an acute angle with the upper panel to form a supporting leg to facilitate the displaying of the photograph.

6. The photo-mailer assembly according to claim 4 wherein the inner surface of the lower panel and the outer surface of the upper panel are secured in face-to-face relationship.

7. A photo-mailer assembly comprising a unitary sheet of card stock having two generally parallel score lines which divide the sheet into upper, central, and lower panels of substantially equal size, said assembly further comprising inner and outer surfaces, a lateral direction parallel to the score lines and a longitudinal direction perpendicular to the score lines, said central panel including an aperture for displaying a photograph, the inner surface of said upper panel including a strip of adhesive for securing a photograph thereto in alignment with said aperture, the inner surface of said upper panel including adhesive for securing the inner surfaces of said upper and central panels in face-to-face relationship, the inner surface of said lower panel including adhesive for securing the inner surface of said lower panel and the outer surface of said upper panel in face-to face relationship, the outer surface of said central panel including indicia for indicating the location of a recipient address and stamp for sending the assembly through the mail, both surfaces of said assembly being gloss-coated to facilitate detachment of the panels when they are secured in face-to-face relationship.

* * * * *